US007543759B2

(12) United States Patent
George

(10) Patent No.: US 7,543,759 B2
(45) Date of Patent: Jun. 9, 2009

(54) MULTI-VALVE DAMPER FOR CONTROLLING AIRFLOW AND METHOD FOR CONTROLLING AIRFLOW

(76) Inventor: Fred George, 100 Old Stonewall Rd., Easton, CT (US) 06612

( * ) Notice: Subject to any disclaimer, the term of this patent is extended or adjusted under 35 U.S.C. 154(b) by 597 days.

(21) Appl. No.: 11/244,532

(22) Filed: Oct. 5, 2005

(65) Prior Publication Data

US 2006/0027672 A1 Feb. 9, 2006

Related U.S. Application Data

(63) Continuation-in-part of application No. 10/773,662, filed on Feb. 6, 2004, now Pat. No. 6,991,177.

(51) Int. Cl.
*F24F 7/00* (2006.01)
*F25D 17/04* (2006.01)

(52) U.S. Cl. ..... 236/49.3; 62/186; 454/333; 454/334; 137/15.25; 137/601.17

(58) Field of Classification Search ..... 236/49.1, 236/49.3; 62/186; 454/333, 334, 335, 336; 137/15.25, 315.22, 601.17
See application file for complete search history.

(56) References Cited

U.S. PATENT DOCUMENTS

| | | | | |
|---|---|---|---|---|
| 7,713 | A | 10/1850 | Woodside | |
| 1,659,880 | A | 2/1928 | Kauffman | |
| 2,837,991 | A | 6/1958 | De Roo | |
| 3,044,387 | A | 7/1962 | Hinden | |
| 3,070,345 | A | 12/1962 | Knecht | |
| 3,147,768 | A | 9/1964 | Kennedy | |
| 3,592,240 | A | 7/1971 | Hedrick et al. | |
| 3,806,027 | A * | 4/1974 | Ginn et al. | 236/49.4 |
| 4,295,632 | A | 10/1981 | Engelke | |
| 4,366,830 | A | 1/1983 | Becelaere | |
| 4,372,485 | A | 2/1983 | McCabe | |
| 4,416,415 | A | 11/1983 | Kolt | |
| 4,489,917 | A | 12/1984 | Baumann | |
| 4,628,954 | A | 12/1986 | Dayus | |
| 4,633,900 | A | 1/1987 | Suzuki | |
| 4,759,269 | A * | 7/1988 | Brown et al. | 454/75 |
| 4,770,035 | A | 9/1988 | Kolkebeck et al. | |
| 5,481,925 | A | 1/1996 | Woodbury | |
| 5,741,180 | A | 4/1998 | Xia et al. | |
| 6,082,704 | A | 7/2000 | Grinbergs | |
| 6,557,826 | B2 | 5/2003 | Moore et al. | |
| 6,991,177 | B2 * | 1/2006 | George | 236/49.3 |
| 2002/0175307 | A1 | 11/2002 | McCabe et al. | |

* cited by examiner

*Primary Examiner*—Marc E Norman
(74) *Attorney, Agent, or Firm*—Lipsitz & McAllister, LLC

(57) ABSTRACT

The present invention relates to a multi-valve damper which divides a section of an airflow duct into at least two airflow sections. The damper has a plug body having a proximal end and a distal end. The plug body is adapted to separate a section of an airflow duct into at least two airflow sections. At least two damper blades may be mounted on the distal end of the plug body, each of the damper blades controlling airflow in a respective airflow section. At least one airflow sensor may be provided in each of the airflow sections for controlling the respective damper blades. An actuator mechanism responsive to the sensors may be provided for opening and closing the damper blades. At least one of the proximal end and the distal end of the plug body may have an aerodynamic shape.

10 Claims, 6 Drawing Sheets

MULTI-VALVE DAMPER FOR CONTROLLING AIRFLOW AND METHOD FOR CONTROLLING AIRFLOW

This application is a continuation-in-part of commonly owned, co-pending U.S. patent application Ser. No. 10/773,662 filed on Feb. 6, 2004.

BACKGROUND OF THE INVENTION

The present invention relates to an airflow damper for controlling the flow of air in a ventilation system. In particular, the present invention relates to a multi-valve damper which divides a section of an airflow duct into at least two airflow sections, with a damper blade or valve provided for controlling the airflow in each of the airflow sections in response to sensors in each section. The present invention also provides corresponding methods for controlling airflow in a ventilation system.

Air delivery and distribution systems are used for heating, ventilation, and cooling requirements in residential and commercial structures. These systems typically consist of a variety of types and sizes of airflow ducts used to direct air to or from various locations. It is desirable in such airflow systems to be able to accurately control and regulate the airflow in the ductwork. Airflow control and regulation is typically carried out by an adjustable damper or valve, which may be controlled by airflow sensors in the ductwork.

One such prior art device is the venturi valve, such as the venturi valve manufactured by Phoenix Controls Corporation of Acton, Mass. Such venturi valves utilize a duct section in the shape of a venturi. The valve utilizes a cone which rides on a shaft. The shaft is attached to a spring having a constant that is designed to maintain a constant airflow regardless of changes in static pressure in the duct. The valve is typically designed to operate in a pressure independent manner between 0.6" and 3.0" water column static pressure. The shaft can be modulated to vary the flow while the spring/cone slides on the shaft to maintain its pressure independence. The valve does not directly measure airflow, rather it is calibrated in the factory over numerous points and the valve is characterized to maintain a relatively accurate flow control. The valve can be modulated using either a pneumatic or electric actuator. Because of speed and reliability, pneumatic actuation is the preferred method in critical applications such as laboratories.

Another example of a prior art valve mechanism is the Pneumavalve manufactured by Tek-Air Systems Inc. of Danbury, Conn. The Pneumavalve utilizes a series of EPDM (Ethylene-Propylene-Diene Monomer) bladders that are surrounded by sheet metal and spaced approximately 1" apart in a metal casing. A 1-10 psi control signal inflates the bladders so that they restrict airflow in a duct. This valve can be manufactured from either stainless steel or galvanized steel/aluminum depending on the application. The valve is not by itself pressure independent and must be used in conjunction with an airflow sensor in order to be pressure independent. The valve does, however, have a very linear response to a control signal making it a good valve for use in airflow control applications. The valve has virtually no moving parts and therefore good reliability over time. The valve can only operate using pneumatic controlled air. It cannot operate electronically.

A further example of a prior art damper system is a Variable Air Volume (VAV) terminal box. There are numerous manufacturers of VAV terminal boxes including but not limited to Titus of Richardson, Tex., Anemostat of Carson, Calif., Krueger of Richardson, Tex., Tuttle & Bailey of Richardson, Tex., and Price Industries of Suwanee, Ga. A VAV terminal box is simply a cylindrical section of sheet metal with a round blade on a shaft in the duct section. The blade is rotated throughout a 90 degree arc to vary the flow in a duct. The damper in and of itself is not pressure independent but a flow sensor is typically mounted on the inlet and a simple controller is used to maintain desired flow. Because the device utilizes a pitot tube flow sensor it is limited in the turndown in flow that it can handle. Blade dampers are not linear devices so accurate control of airflow is very limited. When the device is moving from fully closed to open there is initially a relatively large change in airflow versus control signal and the reverse happens when the valve is close to fully open. This type of product is relatively inexpensive and is predominately used for temperature control where speed and accuracy is not important.

Another prior art device is the blade damper. There are numerous manufacturers of blade dampers including but not limited to Titus of Richardson, Tex., Anemostat of Carson, Calif., Krueger of Richardson, Tex., Tuttle & Bailey of Richardson, Tex., and Price Industries of Suwanee, Ga. This product is simply a cylindrical section of sheet metal with a round blade on a shaft in the duct section. The blade is rotated throughout a 90 degree arc to vary the flow in a duct. The damper in and of itself is not pressure independent but a flow sensor can be mounted on the inlet and a simple controller is used to maintain desired flow. Because the device utilizes a pitot tube flow sensor it is limited in the turndown in flow that it can handle. Blade dampers are not linear devices so accurate control of airflow is very limited. When the device is moving from fully closed to open there is initially a relatively large change in airflow versus control signal and the reverse happens when the valve is close to fully open. This type product is relatively inexpensive and is predominately used for temperature control where speed and accuracy is not important.

Opposed blade and parallel blade dampers are also known in the prior art. There are numerous manufacturers of such blade dampers including but not limited to Titus of Richardson, Tex., Anemostat of Carson, Calif., Krueger of Richardson, Tex., Tuttle & Bailey of Richardson, Tex., and Price Industries of Suwanee, Ga. This product is a rectangular section of sheet metal with multiple blades mounted on shafts in the duct section. The number of blades is dependant upon the size of the duct. The blades are rotated throughout a 90 degree arc to vary the airflow in a duct. The blades are rotated either in a parallel or opposed manner. The damper in and of itself is not pressure independent but a flow sensor can be mounted on the inlet and a controller is used to maintain desired flow. If the device utilizes a pitot tube flow sensor it is limited in the turndown in flow that it can handle. Blade dampers are not linear devices so accurate control of airflow is very limited. When the device is moving from fully closed to open there is initially a relatively large change in airflow versus control signal and the reverse happens when the valve is close to fully open. Opposed blade dampers are better for control than parallel blade dampers.

The above-described prior art has numerous shortcomings. Both the VAV terminal boxes and the Pneumavalve require a secondary device such as an airflow sensor to be pressure independent. Further, the accuracy and turndown can be seriously limited which is problematic in many applications.

The venturi valve does not use any means of measuring airflow, relying instead on factory calibration and flow characterization to achieve its stated accuracy. In addition, the venturi valve is a complicated device with numerous levers, springs and a cone that must ride smoothly on a shaft for the accuracy to be maintained.

The Pneumavalve only operates on controlled pneumatic air. The product can not operate on an electric signal. In order to use the Pneumavalve, air compressors must be supplied on a project as well as an electric to pneumatic converter to convert the electronic control signal to a pneumatic signal.

Therefore, in order to overcome the aforementioned difficulties associated with the prior art, it would be advantageous to provide a device that is designed to provide efficient and reliable airflow modulation, using either electric or pneumatic control. It would also be advantageous to provide built in airflow measurement capabilities in the device. This gives the product pressure independence over a very wide airflow range. It would also be advantageous to for such a device to divide the airflow into separate airflow sections. The resulting increased airflow velocity in each of the sections allows a much greater turndown of flow than conventional products and a more laminar flow past the flow sensors for improving accuracy. Dampers in each airflow sections can be operated separately for greater modulation control. Further, it would be advantageous if the dampers in each airflow section move in the same direction creating less turbulence and therefore less noise and system effect as compared to a conventional prior art blade damper.

It would be still further advantageous to provide a design where fewer valves will cover a wider range of airflows than VAV boxes or blade dampers, making ventilation system design and product selection easier. It would be further advantageous to provide very fast response speeds for critical applications. Such a device should be very simply constructed and have a minimum of moving parts to provide for increased reliability and durability as compared to the prior art.

The present invention provides the foregoing and other advantages.

SUMMARY OF THE INVENTION

The present invention relates to a multi-valve damper for controlling airflow in a ventilation system. The present invention also provides corresponding methods for controlling airflow in a ventilation system.

In an example embodiment of the present invention, a multi-valve damper for an airflow duct is provided. The damper has a plug body having a proximal end and a distal end. The plug body adapted to fit within an airflow duct and to separate a section of an airflow duct into at least two airflow sections. At least two damper blades may be mounted on the distal end of the plug body, each of the damper blades controlling airflow in a respective airflow section.

In one example embodiment of the invention, the plug body may bifurcate the duct section into two airflow sections. However, those skilled in the art will appreciate that the plug body may be adapted to separate the duct section into three or more airflow sections, with a damper blade in each airflow section at the distal end of the plug body.

The airflow sections may comprise equal sections. However, the airflow sections may also be unequal, depending on the application and level of airflow control desired.

At least one airflow sensor may be provided in each of the airflow sections for controlling the damper blade in the respective airflow section. The at least one sensor may comprise at least one of a vortex type sensor, a pitot type sensor, a thermal type sensor, or any other type of airflow sensor now known in the art or to be developed.

An actuator mechanism responsive to the sensors may be provided for opening and closing the damper blades. The blades may be controlled so that they open and close simultaneously or independently with one another. Alternatively, an actuator mechanism may be associated with each damper blade. Each of the actuator mechanisms may be responsive to the at least one airflow sensor in a respective airflow section for opening and closing each damper blade independently. The actuator mechanisms may be either electrically controlled or pneumatically controlled.

The proximal end of the plug body may have an aerodynamic shape that minimizes the disruption of airflow into the airflow sections. The distal end of the plug body may have a substantially flat shape.

In a further embodiment of the present invention, the distal end of the plug body may have an aerodynamic shape that minimizes the disruption of airflow out of the airflow sections. Alternatively, each of the proximal end and the distal end of the plug body may have an aerodynamic shape in order to minimize the disruption of the airflow into and out of the airflow sections.

The damper blades may be mounted such that each damper blade closes its respective airflow section when the damper blade is at an angle of approximately 45 degrees with respect to a longitudinal axis of the plug body. The damper blades may be mounted such that each damper blade rotates through an angle of approximately 45 degrees from fully closed to fully opened. Alternatively, the damper blades may be mounted such that each damper blade closes its respective airflow section when the damper blade is at an angle of approximately 90 degrees with respect to a longitudinal axis of the plug body. In such an example embodiment, each damper blade may rotate through an angle of 90 degrees from fully closed to fully opened.

The duct section may be round, rectangular, or oval. The airflow duct may be constructed of aluminum, galvanized steel, stainless steel, fiberglass, plastic, or any other suitable material.

The present invention may also be configured to act as a packed or packless duct silencer. In an example embodiment of the present invention, at least the proximal end of the plug body may be perforated. For example, at least the proximal end of the plug body may be constructed of perforated sheet metal. In addition, at least the perforated portion of the plug body may be packed with a fiberglass material. Further, the inner walls of the duct section may be perforated. For example, the inner walls of the duct section may be lined with perforated sheet metal. In addition, a fiberglass material may be packed between the perforated sheet metal and the inner walls.

In a further embodiment of the present invention, the plug body may be adapted to act as a pitot tube having a total pressure chamber and a pitot chamber. For example, the proximal end of the plug body may be adapted to form the total pressure chamber for measuring air velocity pressure in the airflow duct. A central section of the plug body between the proximal end and the distal end may be adapted to form the pitot chamber for measuring air velocity pressure in at least one of the airflow sections.

In such an embodiment, the proximal end of the plug body may have an aerodynamic shape with perforations along a leading edge thereof and the central section of the plug body may have perforations along at least one side thereof.

A differential pressure transmitter may be connected to the total pressure chamber and the pitot chamber for converting velocity pressure measurements from the total pressure chamber and the pitot chamber into a velocity signal representative of airflow in at least one of the airflow sections.

The present invention also provides methods for controlling airflow in an airflow duct corresponding to the multi-valve damper described above. An example method of the invention comprises separating a section of an airflow duct into at least two airflow sections, and providing a damper blade at the end of each of the airflow sections for controlling airflow in each airflow section.

The method may further include providing at least one airflow sensor in each airflow section for controlling the damper blades. An actuator mechanism responsive to the sensors may be provided for opening and closing the damper blades simultaneously. Alternatively, an actuator mechanism may be associated with each damper blade. Each actuator mechanism may be responsive to the at least one airflow sensor in a respective airflow section for opening and closing a respective damper blade independently of the other damper blades.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
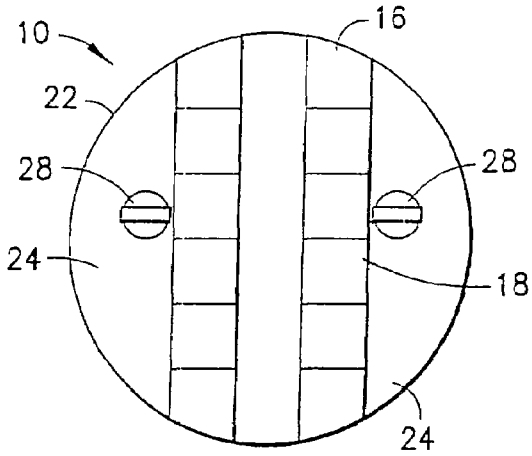
FIG. 1 shows an inlet side elevation view of an example embodiment of the present invention.
Figure 2:
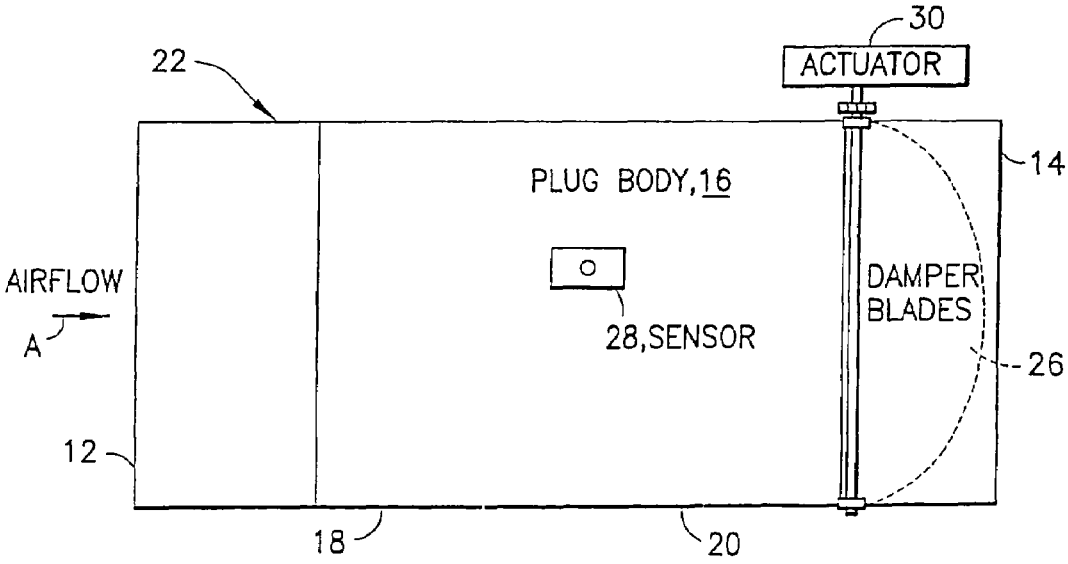
FIG. 2 shows a side elevation view of the example embodiment shown in FIG. 1.

In an example embodiment of the present invention as shown in FIGS. 1-4, a multi-valve damper 10 for an airflow duct is provided. As shown in FIG. 2, the airflow duct may have inlet section 12 and an outlet section 14, the size of which may vary depending on the airflow requirements of the application. The damper has a plug body 16 having a proximal end 18 and a distal end 20. The plug body 16 is adapted to fit within an airflow duct and to separate a section 22 of an airflow duct into at least two airflow sections 24 (FIG. 1). At least two damper blades 26 may be mounted on the distal end 20 of the plug body 16, each of the damper blades 26 controlling airflow in a respective airflow section 24 (FIG. 1).

Figure 3:
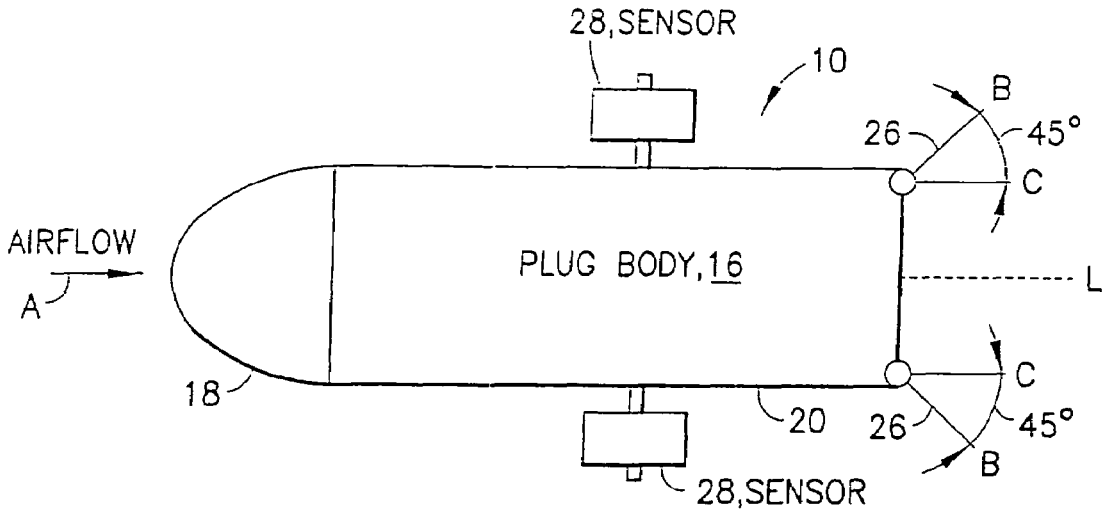
FIG. 3 shows a plan view of the example embodiment shown in FIG. 1.

As shown in FIGS. 2 and 3, the plug body is fitted within the duct section 22 such that the proximal end 18 of the plug body 16 separates the air flowing in the airflow duct in the direction of Arrow A into separate airflow sections 24. Dividing the duct section 22 into separate airflow sections 24 increases the velocity of the air flowing through the duct section 22, which enables airflow to be easily measured at much lower velocities than can normally be measured. This enables airflow measurement and control of the damper blades 26 with much greater flow turndown rates. The increased airflow velocity from dividing the airflow also makes the airflow more laminar so that the flow sensor(s) can be mounted closer to the proximal end 18, as well as closer to the damper blades 26, keeping the overall length of the device shorter than what would normally be required.

In the example embodiment of the invention shown in the Figures, the plug body 16 may bifurcate the duct section 22 into two airflow sections 24. Although FIG. 1 shows only two airflow sections 24 and FIG. 4 shows only two damper blades 26, those skilled in the art will appreciate that the plug body 16 may be adapted to separate the duct section 22 into three or more airflow sections 24, with a damper blade 26 in each airflow section 24 at the distal end 20 of the plug body 16.

The airflow sections 24 may comprise equal sections as shown in the Figures. However, the airflow sections 24 may also be unequal in size, depending on the application and level of airflow control desired. Further, the size of the airflow sections 24 may vary depending on the application.

Figure 5:
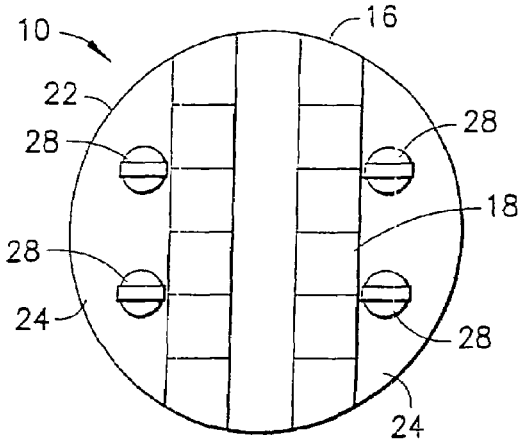
FIG. 5 shows an inlet side elevation view of an alternate example embodiment of the present invention.
Figure 6:
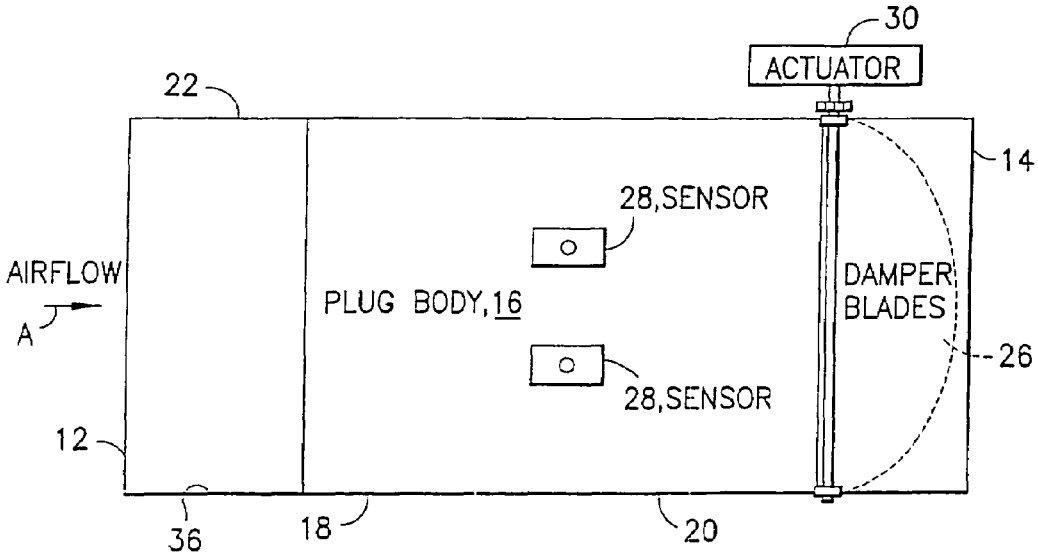
FIG. 6 shows a side elevation view of the alternate example embodiment shown in FIG. 5.

At least one airflow sensor 28 may be provided in each of the airflow sections 24 for controlling the respective damper blades 26. The at least one sensor 28 may comprise at least one of a vortex type sensor, a pitot type sensor, a thermal type sensor, or any other type of airflow sensor known in the art. FIGS. 1-3 show an example embodiment of the present invention having one airflow sensor 28 in each airflow section 24. FIGS. 5 and 6 show an alternate example embodiment having two airflow sensors 28 in each airflow section 24.

Figure 4:
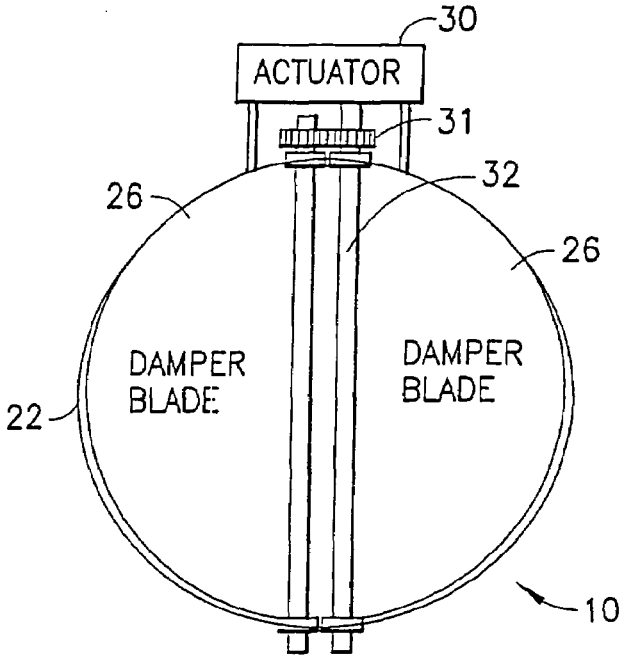
FIG. 4 shows an outlet side elevation view of the example embodiment shown in FIG. 1.
Figure 7:
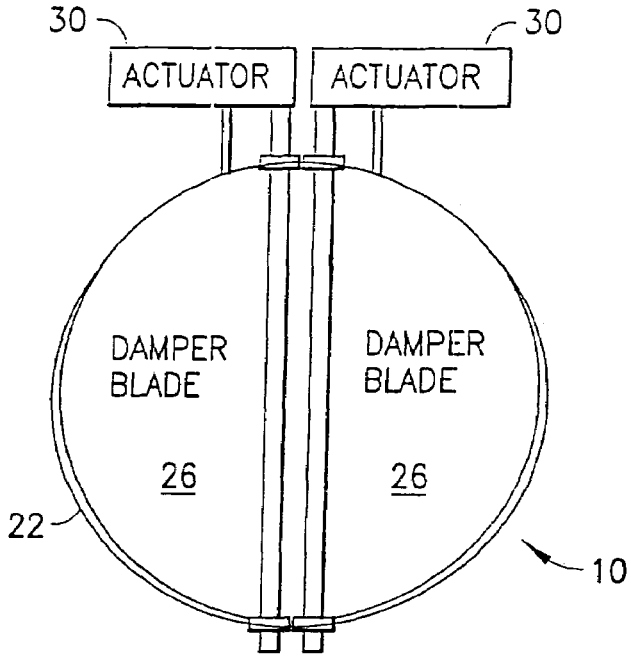
FIG. 7 shows an outlet elevation view of an alternate example embodiment of the present invention.

An actuator mechanism 30 responsive to the airflow sensors 28 may be provided for opening and closing the damper blades 26 (FIGS. 2 and 4). The actuator mechanism 30 may comprise gears 31 and/or linkage 32 between the damper blades and an actuator motor (e.g., included within the actuator 30). The damper blades 26 may be controlled so that they open and close either simultaneously with one another or independently of one another. FIGS. 2 and 4 show an example embodiment having a single actuator mechanism 30 controlling two damper blades 26. Alternatively, an actuator mechanism 30 may be associated with each damper blade 26 as shown in the example embodiment of FIG. 7. In such an embodiment as shown in FIG. 7, each of the actuator mechanisms 30 may be responsive to the at least one airflow sensor 28 in a respective airflow section 24 for opening and closing a respective damper blade 26 independently of the other damper blades. The actuator mechanism(s) 30 may be either electrically controlled or pneumatically controlled.

Further, the damper blades 26 may be controlled such that they open and close in the same direction. By providing separate dampers for each airflow section, they can each be opened away from the airflow, unlike a single blade damper where one side opens into the airflow and the other side opens away from the airflow.

The proximal end 18 of the plug body 16 may have an aerodynamic or airfoil type shape which minimizes the disruption of airflow (shown by Arrow A in FIG. 3) into the airflow sections 24. The distal end 20 of the plug body 16 may have a substantially flat shape. When the damper blades 26 are fully open, the damper blades 26 complete the airfoil shape making the plug body 16 airfoil shaped on both the upstream and downstream sides. This give both less pressure drop and less noise since there is less flow turbulence.

The damper blades 26 may be mounted such that each damper blade 26 fully closes its respective airflow section 24 when the damper blade 26 is at an angle of approximately 45 degrees with respect to a longitudinal axis L of the plug body 16, as shown in FIG. 3. Further, the damper blades 26 may be mounted such that each damper blade 26 rotates through an angle of approximately 45 degrees from a fully closed position B to a fully opened position C. Therefore, the speed of response in a two blade embodiment of the present invention is twice as fast as a typical prior art single blade damper, which must rotate through 90 degrees from fully opened to fully closed.

Figure 8:
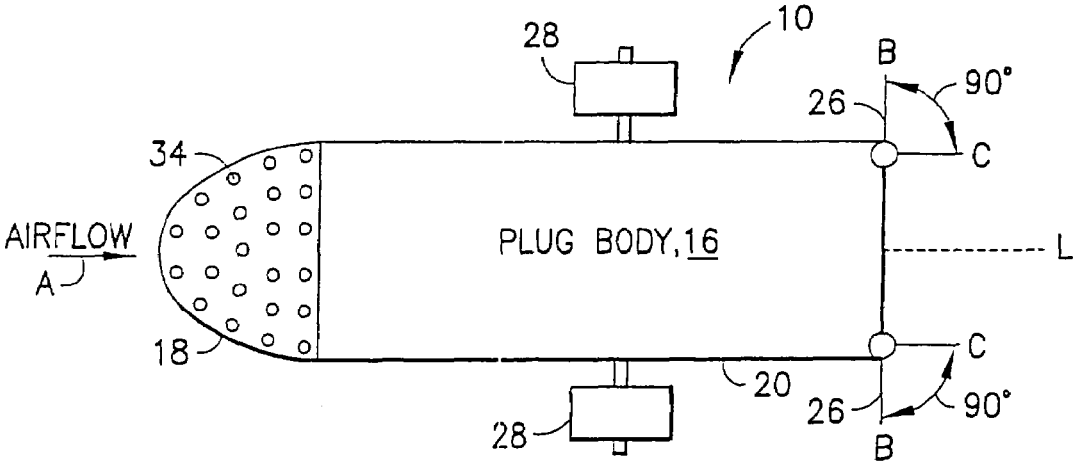
FIG. 8 shows a plan view of an alternate example embodiment of the present invention.

In an alternative example embodiment of the present invention as shown in FIG. 8, the damper blades 26 may be mounted such that each damper blade 26 fully closes its respective airflow section 24 when the damper blade 26 is at an angle of approximately 90 degrees with respect to a longitudinal axis L of the plug body 16. In such an embodiment, the damper blades 26 may be mounted such that each damper blade 26 rotates through an angle of 90 degrees from a fully closed position B to a fully opened position C.

The Figures show the plug body 16 fitted within a round duct section 22. However, those skilled in the art will appreciate that the duct section 22 may be round, rectangular, or oval, and the plug body 16 may be shaped accordingly to fit within a round, rectangular, or oval duct section 22. The airflow duct may be constructed of aluminum, galvanized steel, stainless steel, fiberglass, plastic, or any other suitable material.

The damper blades 26 may be flat blades which are shaped to fit the respective airflow sections 24 so that, when fully closed, the damper blades fully cut off the airflow through each airflow section. For example, in a round section of duct, the damper blades for each section may comprise a half-round disc. Similarly, in a square duct section, the damper blades may be square or rectangular as required to fit the airflow sections.

The present invention may also be configured to act as a packed or packless duct silencer. This can be accomplished by lining inner walls of the duct section 22 with perforated sheet metal and/or making the plug body 16 out of perforated sheet metal. Perforated sheet metal is used for its sound absorbing qualities. In an example embodiment of the present invention as shown in FIG. 8, at least the proximal end 18 of the plug body 16 have perforations 34. For example, at least the proximal end 18 of the plug body 16 may be constructed of perforated sheet metal. In addition, at least the perforated portion of the plug body 16 may be packed with a fiberglass material. Those skilled in the art will appreciate that the entire plug body 16 may be constructed of perforated sheet metal and packed with the fiberglass material. Further, inner walls 36 (FIG. 6) of the duct section 22 may have perforations (not shown) similar to the perforations 34 of the plug body 16. For example, the inner walls 36 of the duct section 22 may be lined with perforated sheet metal. In addition, a fiberglass material may be packed between the perforated sheet metal and the inner walls 36 of the duct section 22.

The fiberglass packing material may be used for standard supply and exhaust applications to provide better sound absorption than can be achieved with the perforated sheet metal alone. For fume hood exhaust applications, the packing material is not recommended as it may become contaminated with particulate matter from the hood.

Figure 9:
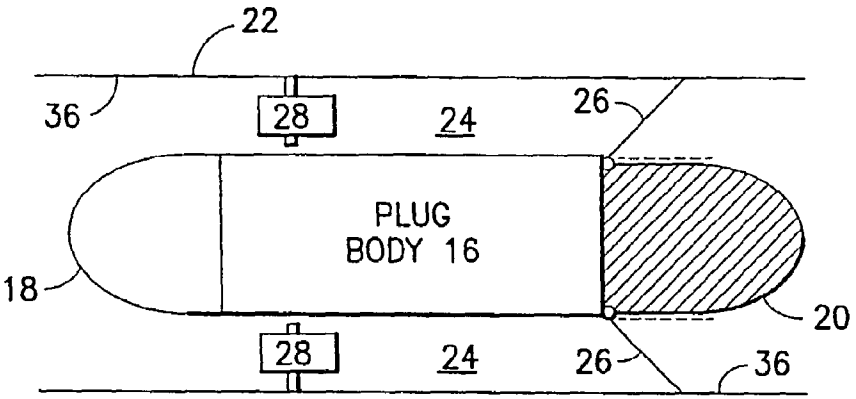
FIG. 9 shows a plan view of an alternate example embodiment of the present invention.

In an alternate embodiment of the present invention as shown in FIG. 9, the proximal end 18 of the plug body 16 may have an aerodynamic shape that minimizes the disruption of airflow into the airflow sections 24 and/or the distal end 20 of the plug body 16 may have an aerodynamic shape that minimizes the disruption of airflow out of the airflow sections 24. For example, each of the proximal end 18 and the distal end 20 of the plug body 16 may have an aerodynamic shape in order to minimize the disruption of the airflow into and out of the airflow sections 24.

Figure 10:
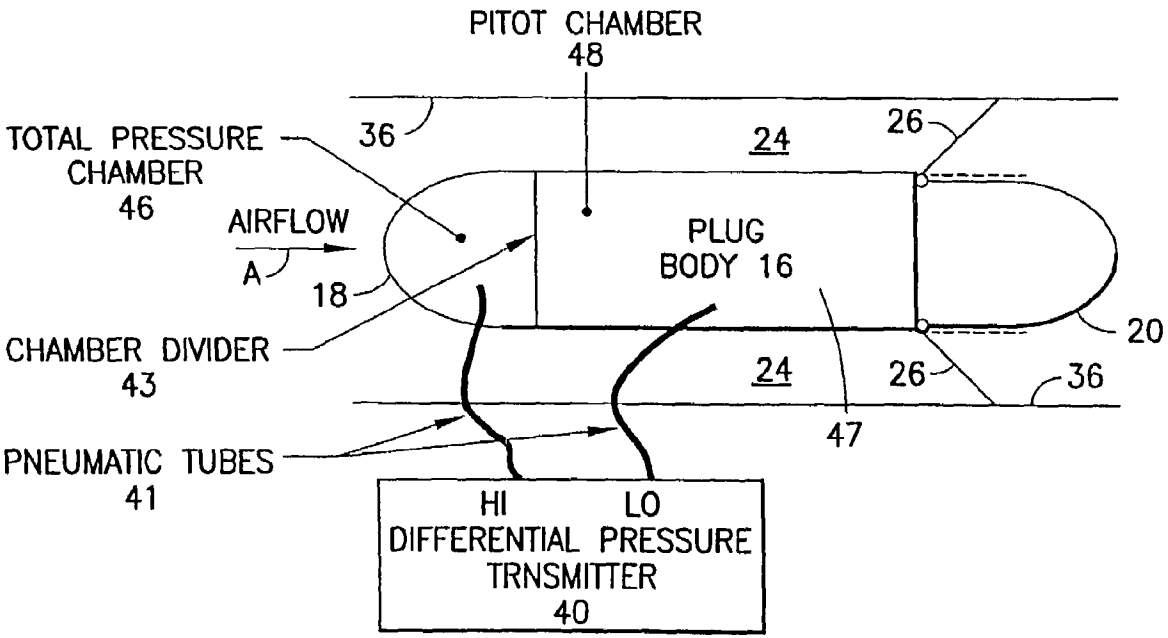
FIG. 10 shows a plan view of an alternate example embodiment of the present invention.
Figure 11:
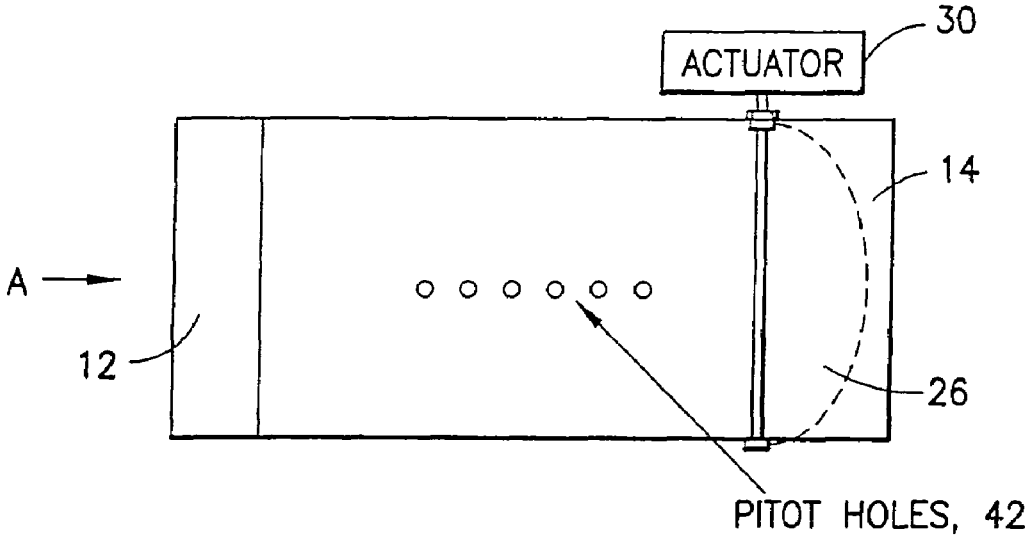
FIG. 11 shows a side elevation view of the alternate example embodiment shown in FIG. 10.
Figure 12:
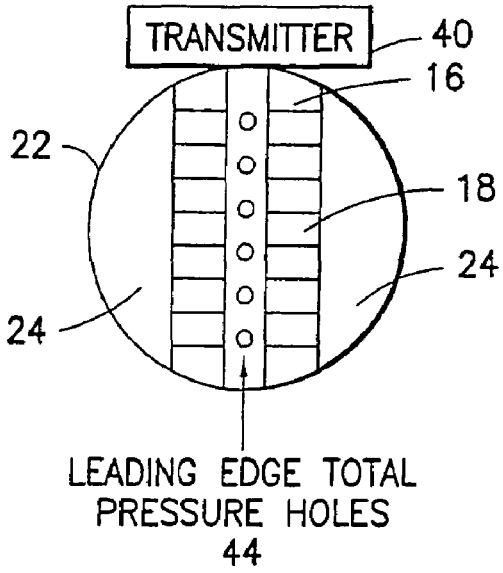
FIG. 12 shows an inlet side elevation view of an alternate example embodiment of the present invention shown in FIG. 10.

In a further embodiment of the present invention as shown in FIGS. 10-12, the plug body 16 may be adapted to act as a pitot tube having a total pressure chamber 46 and a pitot chamber 48. The total pressure chamber 46 and the pitot chamber 48 may be separated by chamber divider 43. The proximal end 18 of the plug body 16 may be adapted to form the total pressure chamber 46 for measuring air velocity pressure in the airflow duct section 22. A central section 47 of the plug body 16 between the proximal end 18 and the distal end 20 may be adapted to form the pitot chamber 48 for measuring air velocity pressure in at least one of the airflow sections 24.

In such an embodiment, the proximal end 18 of the plug body 16 may have an aerodynamic shape with perforations 44 along a leading edge thereof to allow for airflow into said total pressure chamber 46, as shown in FIG. 12. The central section 47 of the plug body 16 may have perforations 42 along at least one side thereof to allow for airflow into said pitot chamber 48, as shown in FIG. 11.

A differential pressure transmitter 40 may be connected to the total pressure chamber 46 and the pitot chamber 48 for converting velocity pressure measurements from the total pressure chamber 46 and the pitot chamber 48 into a velocity signal representative of airflow in at least one of the airflow sections 24. The differential pressure transmitter 40 may be connected to the total pressure chamber 46 and the pitot chamber 48 by pneumatic tubes 41.

With the plug body 16 adapted to act as a pitot chamber, separate airflow sensors in the airflow sections are not needed.

It should now be appreciated that the present invention provides advantageous methods and apparatus for controlling airflow in a section of an airflow duct.

Although the invention has been described in connection with various illustrated embodiments, numerous modifications and adaptations may be made thereto without departing from the spirit and scope of the invention as set forth in the claims.

What is claimed is:

1. A multi-valve damper for an airflow duct, comprising:

a plug body having a proximal end and a distal end, said plug body adapted to separate said duct section into at least two airflow sections and to act as a pitot tube having a total pressure chamber and a pitot chamber; and at least two damper blades mounted on said distal end of said plug body, each of said damper blades controlling airflow in a respective airflow section;

wherein;

at least one of said proximal end and said distal end of said plug body has an aerodynamic shape;

said proximal end of said plug body is adapted to form said total pressure chamber for measuring air velocity pressure in the airflow duct; and a central section of said plug body between said proximal end and said distal end is adapted to form said pitot chamber for measuring air velocity pressure in at least one of said airflow sections.

2. A damper in accordance with claim 1, wherein:

said plug body bifurcates said duct section into two airflow sections.

3. A damper in accordance with claim 1, wherein:

each of said proximal end and said distal end of said plug body has an aerodynamic shape.

4. A damper in accordance with claim 1, wherein:

said proximal end of said plug body has an aerodynamic shape with perforations along a leading edge thereof; and said central section of said plug body has perforations along at least one side thereof.

5. A damper in accordance with claim 4, further comprising:

a differential pressure transmitter connected to said total pressure chamber and said pitot chamber for converting velocity pressure measurements from said total pressure chamber and said pitot chamber into a velocity signal representative of airflow in at least one of said airflow sections.

6. A method for controlling airflow in an airflow duct, comprising:

providing a plug body having a proximal end and a distal end, said plug body adapted to separate a section of the airflow duct into at least two airflow sections and to act as a pitot tube having a total pressure chamber and a pitot chamber;

providing a damper blade at an end of each of said airflow sections for controlling airflow in each airflow section;

wherein;

at least one of said proximal end and said distal end of said plug body has an aerodynamic shape;

said proximal end of said plug body is adapted to form said total pressure chamber for measuring air velocity pressure in the airflow duct; and a central section of said plug body between said proximal end and said distal end is adapted to form said pitot chamber for measuring air velocity pressure in at least one of said airflow sections.

7. A method in accordance with claim 6, wherein:

said duct section is bifurcated into two airflow sections.

8. A method in accordance with claim 6, wherein:

each of said proximal end and said distal end of said plug body has an aerodynamic shape.

9. A damper in accordance with claim 6, wherein:

said proximal end of said plug body has an aerodynamic shape with perforations along a leading edge thereof; and said central section of said plug body has perforations along at least one side thereof.

10. A damper in accordance with claim 9, further comprising:

a differential pressure transmitter connected to said total pressure chamber and said pitot chamber for converting velocity pressure measurements from said total pressure chamber and said pitot chamber into a velocity signal representative of airflow in at least one of said airflow sections.

* * * * *